United States Patent [19]

Kawaguchi

[11] 4,377,379

[45] Mar. 22, 1983

[54] DENTAL TREATMENT ROOM

[76] Inventor: Sachiko Kawaguchi, 205-Go, 2-4-26, Kohama, Suminoe-ku, Osaka, Japan

[21] Appl. No.: 300,811

[22] Filed: Sep. 10, 1981

[51] Int. Cl.[3] ..... A61G 15/00

[52] U.S. Cl. ..... 433/77

[58] Field of Search ..... 433/33, 77

[56] References Cited

FOREIGN PATENT DOCUMENTS 1491071 7/1965 Fed. Rep. of Germany ..... 433/33

*Primary Examiner*—Robert Peshock

*Attorney, Agent, or Firm*—Moonray Kojima

[57] ABSTRACT

This invention is mainly concerned with a particular dimensional construction of dental treatment room wherein a dental assistant operation floor area is partitioned in a tier higher up than a dental surgeon operation floor area so that the dentist is able to concentrate upon his or her dental treatment to a patient without inadvertently touching the assistant on the head, elbow or toes.

3 Claims, 3 Drawing Figures

DENTAL TREATMENT ROOM

BACKGROUND OF THE INVENTION

In most of the existing dental clinics of today, both a dental surgeon and his or her assistant generally work on an equal-levelled floor surface area of a dental treatment room, thus being more often than not put to such difficulties that the surgeon, while treating a patient, unexpectedly happen to touch the assistant on the head, elbow or toes, and vice versa. In order to avert from the difficulties, the dentist cannot but always attend delicately to the assistant's seated position and working manner. Likewise the assistant is also forced to work as reservedly as possible so as not to touch the dentist, thus both of them being unable to concentratively treat the patient to their fullest satisfaction.

OBJECTS OF THE INVENTION

Accordingly, the present invention has been designed to eliminate or mitigate the above-mentioned difficulties and has for one of its main objects the provision of a dental chair constructed in a manner that a dentist and a dental assistant can hold mutually different-levelled operating positions in a dental treatment room. That is to say, the assistant can work while seated on a chair positioned in a tier higher up than a chair the dentist is seated on so that the assistant is not only easily able to hand to the dentist any necessary instruments and treating materials but also move his or her chair to carry out any other purposes without inadvertently or unconsciously abutting against the dentist, thus enabling the dentist to concentrate upon treating a patient.

Another object of the invention is to provide a construction of fixture frame for rigidly fixing an assistant's rotary chair on his or her operation floor area which is positioned in a tier higher up than a dentist's operation floor area whereby the chair per se is rotatable about its axis but not movable directionally on the operation floor area. Thus in case with this rotary chair, such a thing can be previously avoided that the assistant may often unconsciously sit on the chair in an occasional position of the operation floor area wherein it happens to be just as in case with the conventional caster-type rotary chairs, the results being that the assistant is always able to operate exactly in a natural seated posture, handing to the dentist any necessary dental instruments and medicines quite free of inadvertently dropping the same.

A still object of the invention is to provide a construction of the operation floor area for a dentist's assistant, the area being positioned in a tier higher up than the operation floor area for the dentist, and provided at an edge thereof with a spatial room for permitting the assistant to put his or her feet into whereby the assistant while seated on a chair is easily accessible to the dentist without unnaturally bending his or her legs, the results being that both of them can concentrate upon their respective treating operation without unexpectedly touching one another on the toes, elbow and head.

BRIEF DESCRIPTION OF DRAWING RELATING TO THE INVENTION

In the accompanying drawings.

DETAILED DESCRIPTION OF THE INVENTION

Figure 1:
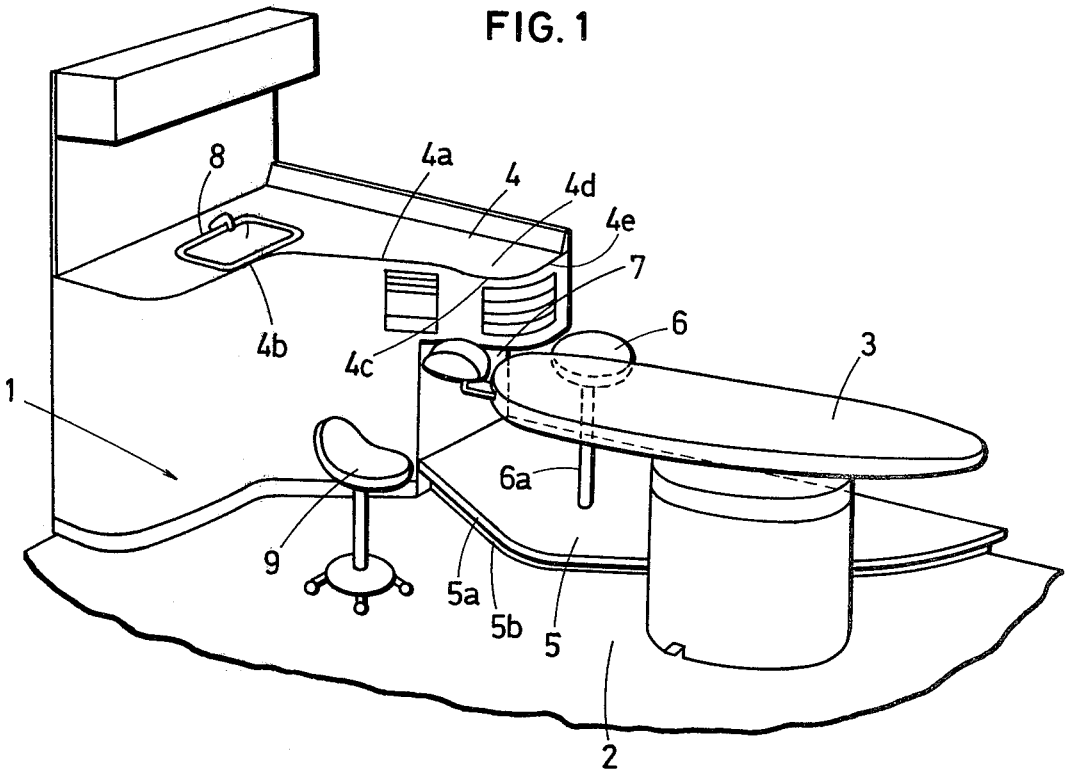
FIG. 1 is a perspective view showing as the whole the construction of the invention.

Setting forth now in detail one of the preferred embodiments of the present invention with reference to the accompanying drawings, wherein reference numeral 1 generally designates a dental treating area. Said area 1 comprises a floor 2 upon which there are a treating seat 3 whose upper surface is made flattened and a treatment cabinet 4 for receiving dental treating instruments and medicines. Between a side of said treating seat 3 and said treatment cabinet 4 there is formed a platform 5 that provides a dental assistant A with an operation floor area $\theta_2$ which will be referred to hereinafter. Said platform 5 is positioned in a tier about ten to 15 centimeters higher up than the floor 2 and at its edges 5*a* adjacent to a dentist D there is formed a spatial room S partitioned by means of a supporting plate 5*b* which supports the platform 5 inwardly of said edge 5*a* so that the dentist D is able to put his or her feet into the spatial room S.

Said treatment cabinet 4 is formed as the whole into a substantially L shape with respect to the top plan view thereof, having its inner edges 4*a*, 4*b* disposed to face the treating seat 3. Said inner edge 4*a* of the treatment cabinet 4 has its extremity curved into a substantially arc shape to form a curvature portion 4*c* whose upper surface portion 4*d* provides, so to speak, a writing desk whereupon the assistant A can write out a prescription while the dentist D is treating a patient P.

By numeral 6 is denoted a rotary chair for exclusive use of the assistant A. Said chair 6 is rigidly fixed to a fixture frame 6*a* in directionally unmovable relation at a particular point of said platform 5 where the assistant A is able to work most effectively. Said fixture frame 6*a* is positioned in the center of the rotary chair 6 externally of a supposed straight line B drawn lineally between an edge 4*e* of said curvature portion 4*c* and a front edge 3*a* of said treating seat 3.

As is shown in FIG. 1 of the accompanying drawings, a lower portion of the curvature portion 4*c* is notched toward the center C of the treatment cabinet 4 to form a notched space 7 whereby the assistant A seated on the rotary chair 6 can freely move about the fixture frame 6*a* toward the treatment cabinet 4 during his or her assisting work.

On the upper surface of said treatment cabinet 4 at one side thereof there is provided a sink 8. Numeral 9 denotes a caster-type rotary chair for exclusive use of the dentist D which is directionally movable and normally disposed within the dentist's working or operation area $\theta_1$ to be described later.

Figure 4:
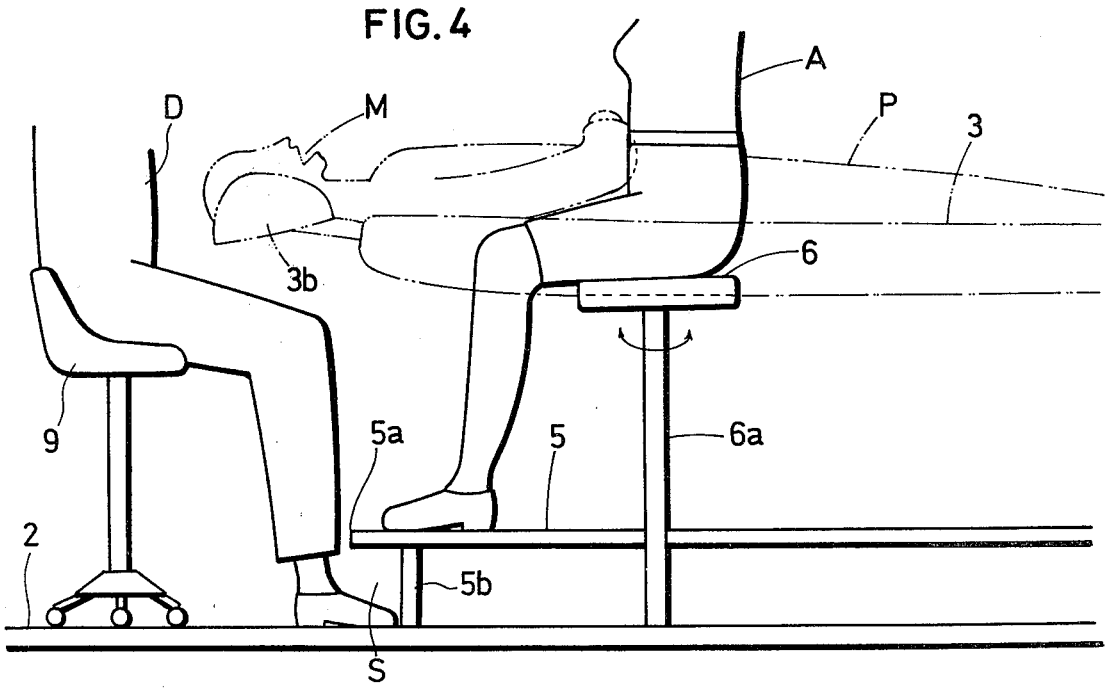
FIG. 4 is a side elevational view showing the positional relation between a dentist and a dental assistant.
Figure 2:
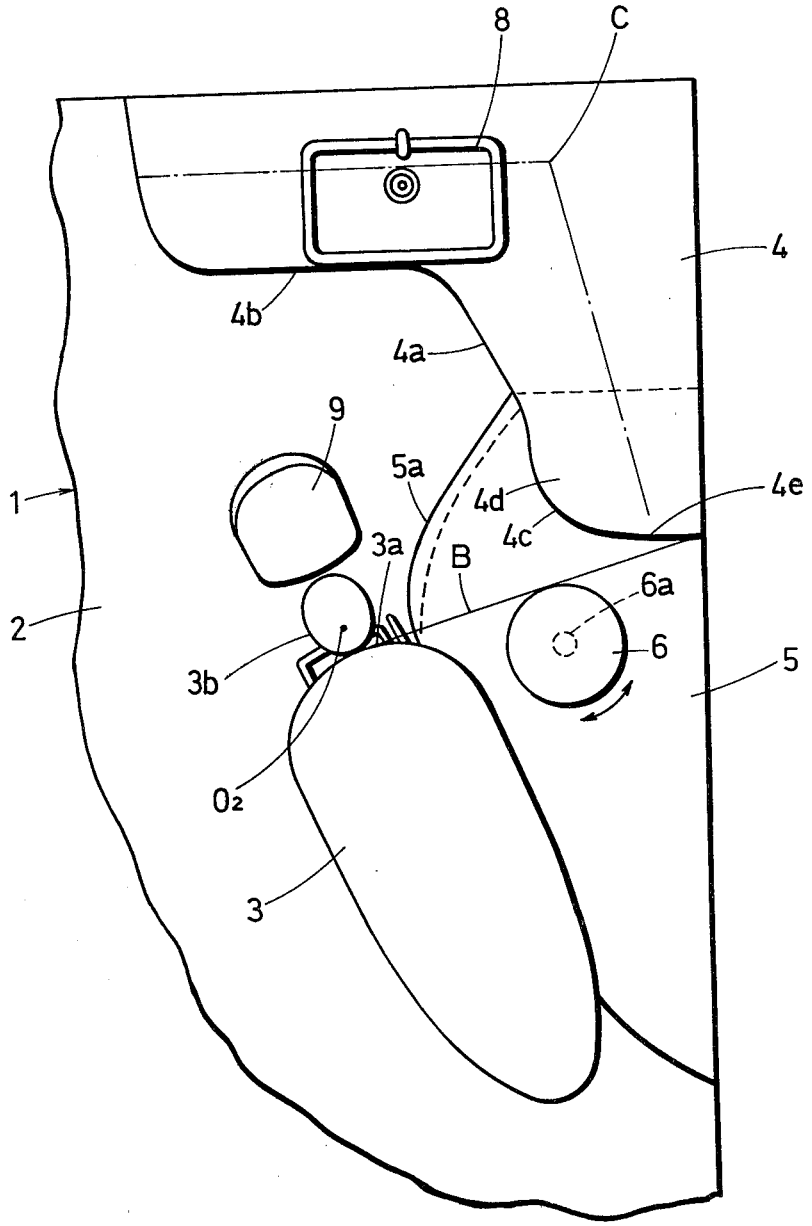
FIG. 2 is a top plan view thereof.
Figure 3:
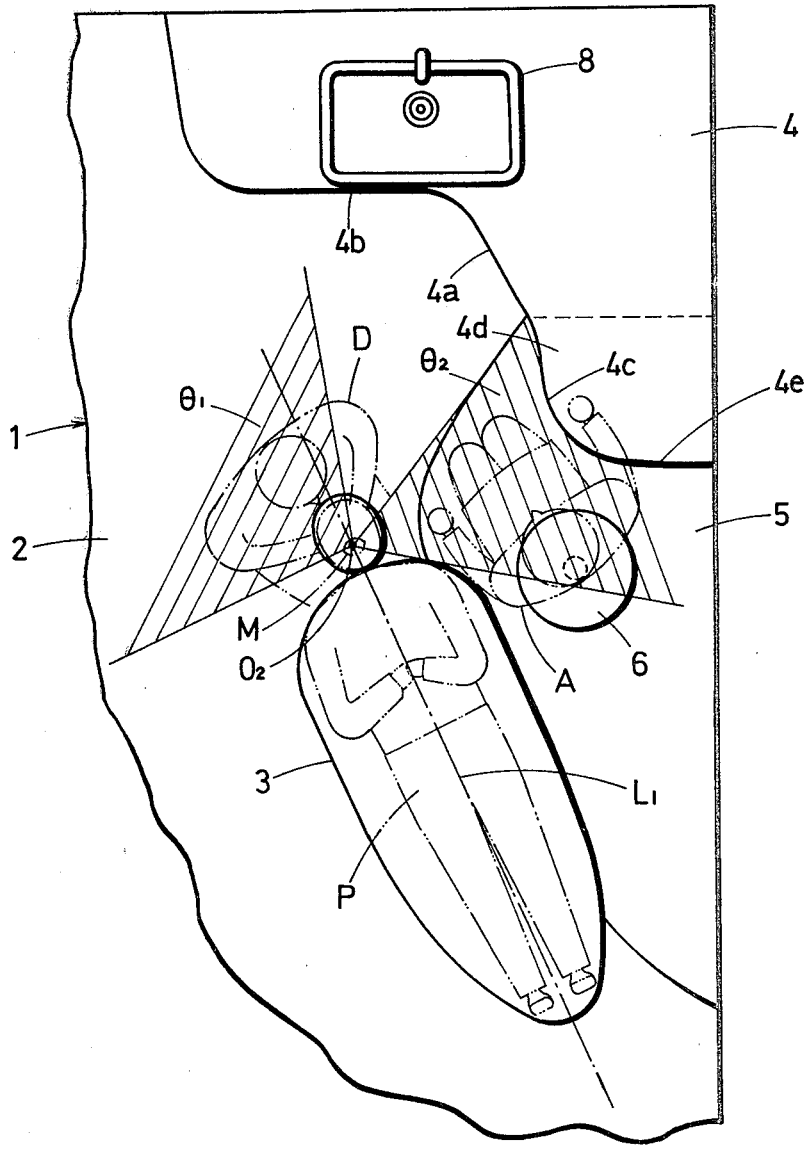
FIG. 3 is a top plan view showing each operation floor area of a dentist and a dental assistant.

Description will now be made of the working area $\theta_1$ for the dentist D and the working area $\theta_2$ for the assistant A, wherein the oral cavity M of the patient P lying down on the treating seat 3 is positioned adjacent to the center $O_2$ of a headrest 3*b* as is clearly shown in FIG. 4. Therefore the dentist D seated on the caster-type rotary chair 8 is naturally caused to operate about said oral cavity M of the patient P. Thus if a supposed center line $L_1$ across the treating seat 3 is compared with a straight line across twelve o'clock and 6 o'clock on a dial-plate as is shown in FIG. 3, all the operations of the dentist D are made within the working area $\theta_1$ ranging at angles between half past twelve and nine, thus the area $\theta_1$ forming an operation area for the dentist D.

On the other hand, the working area $\theta_2$ for the assistant A can be compared with a dial-plate supposing that the oral cavity M of the patient P is a hand axis of a clock, wherein the center of the assistant's body is normally in an area ranging between two o'clock and four o'clock. Accordingly, a floor portion equal at least to said area is formed higher then the other floor portion of a dental treatment room thereby determining a position wherein the assistant's rotary chair 6 is to be rigidly fixed.

According to the present invention, the upper portion of the treating seat 3 being flattened, the oral cavity M of the patient P lying down on the seat 3 is always held in position thereby determining the operation area $\theta_1$ of the dentist D and the operation area $\theta_2$ of the assistant A.

By the above-mentioned construction of the particular operation floor area in accordance with the present invention, the dentist D is always able to work quite free of touching the assistant A on his or her head, elbow or toes, thus concentrating upon dental treating work to the patient P. Likewise, the dental assistant A is also always able to attend to his or her assisting work only, to result in enhancing the efficiency of the assisting work.

What is claimed is:

1. In a dental treatment room having a floor a cabinet disposed on said floor said cabinet having a front and back, treating seat elevated above said floor for holding a patient and located in said front of said cabinet; the improvement comprising a platform having a height above said floor of between 10 to 15 cm and located on one side of said treating seat and extending to be adjacent to and against said front of said cabinet, a horizontally rotatable seat for use by a dental assistant integrally connected to said platform and within a distance accessible by said dental assistant to said cabinet and located on said one side of said treating seat and in said front of said cabinet, a dentist station disposed on said floor and located on another side of said treating seat and in said front of said cabinet, whereby the dentist and dental assistant have areas of work space which do not interfere with each other.

2. The improvement of claim 1, wherein said cabinet has an L shaped configuration with one arm thereof extending toward said rotatable seat, and wherein said rotatable seat is located away from said cabinet and outside of a straight line extending from the end of said one arm, and an end of said treating seat extending toward said cabinet.

3. The improvement of claim 1, wherein said platform has a recess between an upper surface of said platform and said floor at least in the areas accessible by said dentist at said dentist station.

* * * * *